US005935774A

United States Patent [19]

Bringley et al.

[11] Patent Number: 5,935,774

[45] Date of Patent: Aug. 10, 1999

[54] CONTROLLED SITE EPITAXY ON SILVER HALIDE GRAINS

[75] Inventors: Joseph F. Bringley; Roger A. Bryant, both of Rochester, N.Y.

[73] Assignee: Eastman Kodak Company, Rochester, N.Y.

[21] Appl. No.: 09/100,798

[22] Filed: Jun. 19, 1998

[51] Int. Cl.[6] ..... G03C 1/035; G03C 1/07

[52] U.S. Cl. ..... 430/567; 430/569; 430/604

[58] Field of Search ..... 430/567, 569, 430/604

[56] References Cited

U.S. PATENT DOCUMENTS

| | | | |
|---|---|---|---|
| 4,350,758 | 9/1982 | Koitabashi et al. | 430/567 |
| 4,435,501 | 3/1984 | Maskasky | 430/434 |
| 4,463,087 | 7/1984 | Maskasky | 430/567 |
| 4,471,050 | 9/1984 | Maskasky | 430/567 |
| 5,185,241 | 2/1993 | Inoue | 430/598 |

FOREIGN PATENT DOCUMENTS

| | | | |
|---|---|---|---|
| 2093603 | 9/1982 | United Kingdom | G03C 1/72 |

*Primary Examiner*—Mark F. Huff
*Attorney, Agent, or Firm*—Carl O. Thomas

[57] ABSTRACT

A radiation-sensitive silver halide emulsion is disclosed comprised of composite grains including host grains having predominantly {111} crystal faces, cuprous ions adsorbed to the {111} crystal faces of the host grains to act as a site director for subsequently deposited silver salt, and silver salt protrusions having their highest incidence adjacent at least one of the corners and edges of the host grains.

10 Claims, 1 Drawing Sheet

2 μm

5μm

2 μm

CONTROLLED SITE EPITAXY ON SILVER HALIDE GRAINS

FIELD OF THE INVENTION

The invention relates to radiation-sensitive silver halide emulsions useful in imaging.

BACKGROUND

It has been established that composite radiation-sensitive grains formed by the controlled site deposition of silver salt onto host silver halide grains having predominantly {111} crystal faces is capable of improving the photographic performance properties of the emulsion, as illustrated by Maskasky U.S. Pat. Nos. 4,435,501, 4,463,087 and 4,471,050 (hereinafter collectively referred to as the Maskasky salt deposition patents).

The Maskasky salt deposition patents demonstrate that advantageous photographic properties are realized when a site director is employed to direct silver salt deposition preferentially toward the edges and/or corners of the host grains. The Maskasky salt deposition patents demonstrate that high levels of iodide ion in the crystal lattice structure of the host grains or lower levels of iodide ion adsorbed to the host grains are capable of directing silver salt epitaxy. The Maskasky salt deposition patents also demonstrate that adsorbed organic compounds, such as J-aggregating spectral sensitizing dyes and aminoazaindenes (e.g., adenine), are also useful site directors for silver salt epitaxy.

PROBLEM TO BE SOLVED

The limited choice of site directors for forming composite radiation-sensitive grains by the controlled site deposition of silver salt onto host silver halide grains having predominantly {111} crystal faces has restricted the choice of emulsion components and grain compositions.

For example, while surface iodide can be tolerated for many photographic applications, it is well known that iodide slows grain development rates. For this reason in films intended for rapid access processing (dry-to-dry processing in less than 60 seconds and often in less than 30 seconds) iodide is preferably omitted entirely. Iodide is also objectionable in applications where native grain sensitivity is sought to be minimized in the visible spectrum. For this reason iodide incorporation is objectionable in roomlight handleable direct X-ray films and in multicolor films, where minimum blue light sensitivity (and hence color contamination) is sought in minus blue (green or red) recording layer units.

Adsorbed organic site directors can be useful, as in the case of J-aggregating dyes, but the use of these dyes limit the selection of spectral sensitizing dyes that would otherwise be available. When non-sensitizing organic site directors are adsorbed, they are objectionable in that they occupy surface area that would otherwise be available for spectral sensitizing dyes, antifoggants, stabilizers and other photographically useful adsorbed addenda. Maskasky specifically acknowledges the need to displace aminoazaindenes after they have served their purpose as site directors.

SUMMARY OF THE INVENTION

This invention has as its purpose to make available radiation-sensitive silver halide emulsions useful for imaging applications containing composite grains produced by silver salt deposition onto host grains having predominantly {111} crystal faces that avoid the limitations imposed by conventional choices of silver salt deposition site directors.

As demonstrated in the Examples, composite grains produced according to the teachings of the invention exhibit increased speed and maximum contrast and higher maximum density as compared to the same host grains lacking silver salt deposition.

In one aspect this invention is directed to a radiation-sensitive silver halide emulsion comprised of a dispersing medium and composite grains each including a silver halide host grain having predominantly {111} crystal faces, a site director for silver salt deposition adsorbed to the {111} crystal faces of the host grain, and silver salt protrusions having their highest incidence adjacent at least one of the corners and edges of the host grain, wherein the site director is comprised of cuprous ions.

DEFINITION OF TERMS

All references to silver halide grain components, grains, and emulsions containing two or more halides name the halides in order of ascending concentrations.

The terms "high bromide" and "high chloride" in referring to silver halide grain components, grains, and emulsions indicate greater than 50 mole percent bromide or chloride, respectively, based on total silver.

The term "equivalent circular diameter" or "ECD" indicates the diameter of a circle having an area equal to the projected area of a grain.

The term "size" in referring to grains indicates ECD.

The term "coefficient of variation" or "COV" is defined as 100 times the standard deviation of grain size divided by mean grain size.

The term "aspect ratio" indicates the ratio of grain ECD to grain thickness (t).

The term "tabularity" (T) indicates the ratio of aspect ratio (ECD/t) to thickness (t)—i.e. $ECD \div t^2$.

The term "tabular grain" refers to a grain having an aspect ratio of at least 2.

The term "{111} tabular grain" refers to a tabular grain that has major faces that lie in {111} crystal planes.

The term "tabular grain emulsion" refers to emulsions in which tabular grains account for greater than 50 percent of total grain projected area.

The term "epitaxy" refers to the oriented growth of one crystal structure on a measurably different crystal structure.

The term "inertial speed" refers to speed measured at the intersection of two characteristic curve extrapolation lines: an extension of the Dmin portion of the characteristic and an extension of the linear portion of the characteristic curve located between the toe and shoulder portions of the curve.

Speed is reported in units of relative log speed, where a relative speed difference of 30 is an exposure difference of 0.30 log E, where E is exposure in 1 ux-seconds.

Research Disclosure is published by Kenneth Mason Publications, Ltd., Dudley Annex, 21 a North Street, Emsworth, Hampshire P010 7DQ, England.

DESCRIPTION OF PREFERRED EMBODIMENTS

Figure 1:
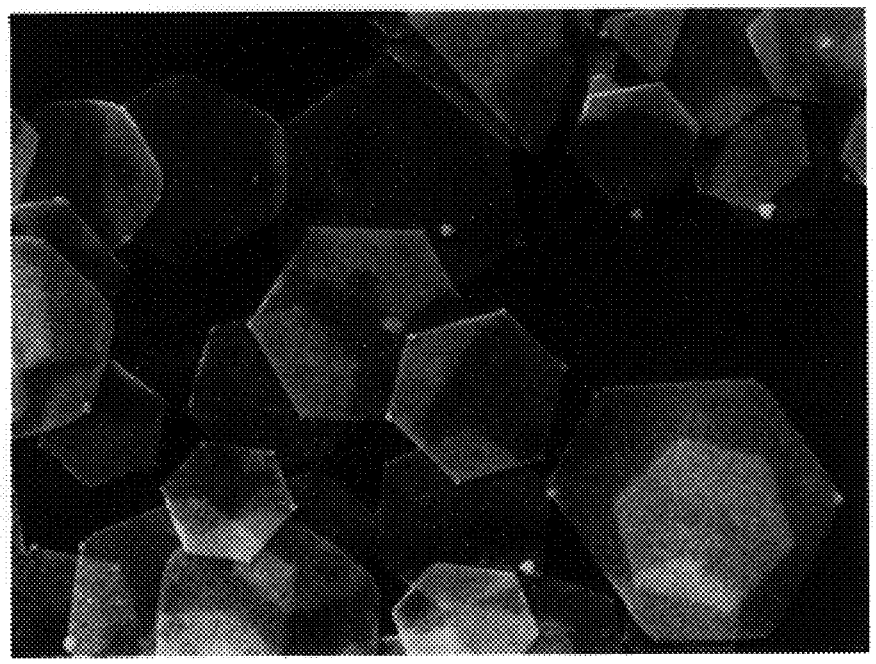
FIGS. 1 and 2 are photomicrographs of emulsions according to the invention.

This invention is directed to radiation-sensitive silver halide emulsions useful in imaging. The emulsions contain a dispersing medium and radiation-sensitive composite grains. The composite grains include silver halide host grains having predominantly {111} crystal faces and silver salt protrusions having their highest incidence adjacent at least one of the corners and edges of the host grains. The location of the protrusions on the host grains is determined by a site director adsorbed to the surface of the host grains.

It has been discovered quite unexpectedly that cuprous ions adsorbed to the {111} crystal faces of the host silver halide grains are capable of acting as a site director for subsequent silver salt deposition.

To provide adsorbed cuprous ions, at any time following precipitation of the host grains a source of cuprous ions is added to the dispersing medium in which the host grains are suspended. Any copper containing compound that is capable of disseminating cuprous ions into the dispersing medium can be employed. Any copper containing compound that is soluble to at least some extent in the dispersing medium can be chosen. Solubility can range from very soluble (e.g., totally miscible) to only very slightly soluble. Since cuprous ions are continuously removed from the dispersing medium by adsorption onto the host grain surfaces, equilibrium forces will drive the copper containing compound toward complete dissolution even when the copper containing compound exhibits only very slight water solubility. This can be appreciated by reference to the following equilibrium formula:

$$CuA \leftrightarrows Cu^{+} + A^{-} \quad (I)$$

where

CuA is a copper compound, and $A^{-}$ is an anionic moiety.

When CuA is a very slightly soluble compound, most of the copper is initially present in CuA rather than dissociated as cuprous ion. However, as cuprous ion is removed from the dispersing medium by adsorption, CuA acts as a source for replacing the small amount of $Cu^{+}$ that must be present in the dispersing medium to maintain equilibrium. If $Cu^{+}$ is removed from the dispersing medium by adsorption as it is replaced, eventually CuA is entirely depleted, and all (or very nearly all) of the copper becomes adsorbed to the surfaces of the host grains.

When the copper compound supplies cupric ($Cu^{++}$) ions rather than cuprous ($Cu^{+}$) ions, the cupric ions can be converted to cuprous ions by a reducing agent incorporated in the dispersing medium. This is illustrated by the following formulae:

$$CuA \leftrightarrows Cu^{++} + A^{-} Cu^{++} + RA \rightarrow Cu^{+} + RA_{OX} \quad (II)$$

where

RA is a reducing agent and $RA_{OX}$ is the oxidized form of the reducing agent.

Generally any reducing agent that will not fog the host grains can be employed. Thus, mild to moderate reducing agents are contemplated. Such reducing agents can be selected, for example, from among known primary and auxiliary silver halide developing agents. Thus, useful reducing agents include hydroquinones, catechols, pyrogallols, aminophenols, pyrazolidones, phenylenediamines, tetrahydroquinolines, bis(pyridone) amines, cycloalkaneones, pyrimidines, reduct-ones, coumarins, and ascorbic acid. Illustrations of silver halide developing agents are contained in *Research Disclosure,* Vol. 389, September 1996, Item 38957, XIX. Development, A. Developing Agents, and in James *The Theory of the Photographic Process,* 4th Ed., Macmillan, New York, 1977, Chapter 11 The Developing agents and Their Reactions.

The following is a listing of specific reducing agents;

RA-1 Ascorbic acid;
RA-2 1-Phenyl-3-pyrazolidone;
RA-3 Pyrogallol;
RA-4 Hydroquinone;
RA-5 Methylhydroquinone;
RA-6 2,6-Dimethylhydroquinone;
RA-7 Chlorohydroquinone;
RA-8 2-Methyl-3-chlorohydroquinone;
RA-9 Bromohydroquinone;
RA-10 2,6-Dichlorohydroquinone;
RA-11 Sodium hydroquinone monosulfonate;
RA-12 p-Phenylenediamine;
RA-13 N,N-Diethyl-p-phenylenediamine monohydrochloride;
RA-14 4-(N-Ethyl-N-2-methanesulfonylaminoethyl)-2-methylphenylenediamine sesquisulfoate monohydrate;
RA-15 4-(N-Ethyl-N-2-hydroxyethyl)-2-methylphenylenediamine sulfate;
RA-16 Aminophenol;
RA-17 N-methylaminophenol hemisulfate;
RA-18 p-β-Hydroethylaminophenol;
RA-19 N-Methyl-N-(β-sulfonamidoethyl)-p-aminophenol;
RA-20 N-Benzyl-p-aminophenol.

When the host grains are provided by ammoniacal precipitation, the pH of the dispersing medium is alkaline. Almost all other emulsions are precipitated in acid pH ranges, typically in the range of from 3 to 7. The reducing action of developing agents generally increases progressively with increasing pH. It is contemplated to adjust the pH of the dispersing medium to optimize the cupric to cuprous ion reduction reaction. Following this reduction reaction, the pH of the dispersing medium can be adjusted to any convenient conventional pH. For example, the emulsion can shifted from an acid pH to a basic pH for reduction of the cupric ion and then returned to an acid pH. Typically, a strong mineral base, such as sodium or ammonium hydroxide, is employed for raising pH while a strong mineral acid, such nitric or sulfuric acid, is used for lowering pH.

The following are illustrations of copper compounds that can be employed to provide cuprous ions directly or following reduction of cupric ions:

C-1 Copper acetate;
C-2 Copper (II) hexammine dichloride;
C-3 Copper (II) tetramine nitrate;
C-4 Copper (II) tetramine sulfate;
C-5 Copper benzoate;
C-6 Copper (II) bromide;
C-7 Copper (II) butyrate;
C-8 Copper (II) chloride;
C-9 Copper chloride thioureate;
C-10 Copper ethylacetoacetate;
C-11 Copper (II) fluoride;
C-12 Copper (II) lactate;
C-13 Copper (II) laurate;
C-14 Copper (II) nitrate;
C-15 Copper (II) oxalate;
C-16 Copper (II) salicylate;
C-17 Copper (II) sulfate, pentahydrate;
C-18 Copper (II) sulfide.

Cuprous ions in an amount of at least 25 percent of monolayer coverage of the host grain surfaces is contemplated to produce a detectably higher concentration of silver salt protrusions adjacent the edges, corners or both of the host grains. Host grain surface area can be calculated from a knowledge of the size, size-frequency distribution, geometrical form (shape) of the grains and total silver present. From a knowledge of the surface area occupied by a single cuprous ion adsorbed to a {111} crystal face and a knowledge of the total amount of cuprous ion added, the amount of cuprous ion theoretically required to cover the entire surface of the host grains with no two cuprous ions overlapping can be calculated. This is what is indicated by monolayer coverage. It is preferred that the cuprous ion be adsorbed in an amount sufficient to provide at least 60 percent of monolayer coverage. Theoretically, a cuprous ion concentration amounting to 100 percent of monolayer coverage would seem ideal and is, in fact, specifically preferred as a lower limit of cuprous ion concentration. In practice cuprous ion concentrations of up to 10 times monolayer coverage are capable of providing advantages, but cuprous ion concentrations of up to 3 times monolayer coverage are preferred and up to 2 times monolayer coverage are specifically preferred.

The cuprous ions adsorb preferentially to the surfaces of the host grains that lie in {111} crystal planes. Theoretically grains can be formed in which the entire exterior surface lies in {111} crystal planes, and grains are often observed in which the overwhelming majority of the grain surface lies in {111} crystal planes. However, absent protective procedures that are rarely used in preparing photographic emulsions, ripening of the host grains occurs preferentially along the edges and at the comers of the grains. This ripening noticeably rounds the comers and edges of the grains. Little of these rounded surfaces lie in {111} crystal planes. Hence, there is a lower incidence of adsorbed cuprous ion at these edge and corner locations than elsewhere on the exterior surface of the host grains.

After adsorption of the cuprous ion to the surfaces of the host grains has occurred, further precipitation of silver salt onto the host grains is directed preferentially to at least one of the edges and comers of the grains. The reason for this is that the silver salt is seeking the host grain surfaces that are most accessible—that is, where adsorbed cuprous ion is least in evidence. The comers of the grains generally exhibit somewhat greater rounding than the edges of the grains. Hence, by limiting the deposition of silver salt, so that equilibrium preferences for deposition are most in evidence, silver salt addition can be preferentially located adjacent the corners of the grains, with the grain edges remote from the corners remaining relatively free of silver salt. With somewhat higher driving forces for silver salt deposition (e.g., introduction of silver salt forming ions at a higher addition rate), preferential deposition of the silver salt adjacent most of the edge regions of the host grains can be observed.

The host grains can be provided by any conventional emulsion precipitation that produces silver halide grains having predominantly {111} crystal faces—that is, greater than 50% of total grain surface area lying in {111} crystal planes. Silver chloride, silver bromide and mixtures of silver bromide and silver chloride in all proportions exhibit a face centered cubic crystal lattice structure that is capable of forming {111} crystal plane surfaces. The face centered cubic crystal lattice structure is capable of tolerating iodide ion up to a solubility limit that is typically cited as 40 mole percent, based on silver, for silver bromide face centered cubic crystal lattice structures and 11 mole percent, based on silver, for silver chloride face centered crystal lattice structures. The actual tolerance for iodide in the face centered cubic crystal lattice structure without phase separation is, however, variable at higher iodide concentrations, depending upon the specific conditions chosen for precipitation, as illustrated by Maskasky U.S. Pat. Nos. 5,238,804 and 5,288,603, the disclosures of which are here incorporated by reference.

Regular host grains can take the form of octahedra, which exhibit eight {111} crystal faces and no identifiable flat crystal face lying in any other crystal plane. A very common alternative form of regular grains are tetradecahedral grains—those that exhibit eight {111} crystal faces and six {100} crystal faces. Although tetradecahedral grains include those that have most of their surface area accounted for by {100} crystal faces as well as those that have most of their surface area accounted by {111} crystal faces, only the latter are contemplated for use in the practice of the invention.

In addition to regular grains bounded predominantly by {111} crystal faces, there are many varied shapes of irregular grains, those resulting from internal crystal lattice defects, such as twin planes and screw dislocations, having predominantly {111} crystal faces. A variety of such irregular grains produced by one or two twin planes are disclosed by E. Klein, H. J. Metz and E. Moisar, "Formation of Twins of AgBr and AgCl Crystals (Grains) in Photographic Emulsions", *Photographische Korrespondez,* 99 (7), pp. 99–102 (1963). Sensitometrically efficient irregular grains include those with multiple (typically more than three) internal non-parallel twin planes. These grains have been described as appearing "lumpy" or "potato-like".

Useful host grain emulsions for use in the practice of the invention can have average ECD's in any known useful size. Since emulsion sensitivity increases with increasing grain size, minimum average grain sizes are typically at least about 0.1 $\mu$m, more typically at least about 0.2 $\mu$m. Since image granularity (noise) increases with increasing grain sizes, mean host grain sizes seldom exceed than 10 $\mu$m and are most typically up to about 5 $\mu$m.

It is preferred that the host grains exhibit lower levels of grain size dispersity. Preferably the coefficient of variation of the host grains in less than 50 percent, most preferably 30 percent. For most imaging applications a COV of less than 10 percent is adequate to achieve the highest required levels of contrast. Typically monodisperse host grain emulsions are preferred that have a COV of less than 20 percent.

Host grain emulsions having predominantly {111} crystal faces can be selected from among those disclosed in *Research Disclosure,* Item 38957, I. Emulsion grains and their preparation.

In a specifically preferred form of the invention the host grain emulsions are tabular grain emulsions. In these emulsions the tabular grains accounting for at least 50 percent of total grain projected area have a thickness of less than 0.3 $\mu$m. Preferably the tabular grains have thicknesses of less than 0.2 $\mu$m. In other words, the host grain emulsion is a thin tabular grain emulsion. Imaging advantages are well known to providing tabular grain emulsions having tabular grain thicknesses of less than 0.07 $\mu$m, commonly referred to as ultrathin tabular grain emulsions.

The average aspect ratio of the tabular grain emulsions employed as host grain emulsions is preferably greater than 5 and most preferably greater than 8. Average aspect ratios of up to 100 are common, although most tabular grain emulsions have average aspect ratios of less than 80. The average tabularity of the host grain emulsion is greater than 25, with tabularities ranging up to 1000 and higher with for thinner tabular grain emulsions.

The tabular grains in the host grain emulsions preferably account for greater than 70 (most preferably greater than 90)

percent of total grain projected area. Tabular grain emulsions which are substantially free of nontabular grains—i.e., exhibit tabular grain projected area of at least 97 percent—are known in the art and specifically contemplated.

The following patents, here incorporated by reference, are illustrative of high chloride tabular grain emulsions having {111} major faces contemplated for use as host grain emulsions in the practice of the invention:

Wey et al U.S. Pat. No. 4,414,306;
Maskasky U.S. Pat. No. 4,400,463;
Maskasky U.S. Pat. No. 4,713,323;
Takada et al U.S. Pat. No. 4,783,398;
Nishikawa et al U.S. Pat. No. 4,952,491;
Ishiguro et al U.S. Pat. No. 4,983,508;
Tufano et al U.S. Pat. No. 4,804,621;
Maskasky U.S. Pat. No. 5,061,617;
Maskasky U.S. Pat. No. 5,178,997;
Maskasky et al U.S. Pat. No. 5,178,998;
Maskasky U.S. Pat. No. 5,183,732;
Maskasky U.S. Pat. No. 5,185,239;
Chang et al U.S. Pat. No. 5,252,452;
Maskasky U.S. Pat. No. 5,298,387;
Maskasky U.S. Pat. No. 5,298,388;
Maskasky U.S. Pat. No. 5,389,509;
Maskasky U.S. Pat. No. 5,399,478;
Maskasky U.S. Pat. No. 5,411,852.

Preferred tabular grain emulsions of use as host grains in the practice of this invention are high bromide tabular grain emulsions in which the tabular grains have {111} major faces. The following patents, here incorporated by reference, are illustrative of emulsions high bromide {111} tabular grain emulsions contemplated for providing the host grain portions of the composite grains:

Wilgus et al U.S. Pat. No. 4,434,226;
Kofron et al U.S. Pat. No. 4,439,520;
Daubendiek et al U.S. Pat. No. 4,414,310;
Solberg et al U.S. Pat. No. 4,433,048;
Yamada et al U.S. Pat. No. 4,647,523;
Sugimoto et al U.S. Pat. No. 4,665,012;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saito et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Antoniades et al U.S. Pat. No. 5,250,403;
Sutton et al U.S. Pat. No. 5,334,469;
Black et al U.S. Pat. No. 5,334,495;
Chaffee et al U.S. Pat. No. 5,358,840;
Delton U.S. Pat. No. 5,372,927;
Maskasky U.S. Pat. No. 5,411,851;
Maskasky U.S. Pat. No. 5,411,853;
Delton U.S. Pat. No. 5,460,934;
Wen U.S. Pat. No. 5,470,698;
Fenton et al U.S. Pat. No. 5,476,760;
Mignot et al U.S. Pat. No. 5,484,697;
Daubendiek et al U.S. Pat. No. 5,494,789;
Olm et al U.S. Pat. No. 5,503,970;
Daubendiek et al U.S. Pat. No. 5,503,971;
Wen et al U.S. Pat. No. 5,536,632;
Daubendiek et al U.S. Pat. No. 5,576,168;
Daubendiek et al U.S. Pat. No. 5,573,902;
Olm et al U.S. Pat. No. 5,576,171;
Deaton et al U.S. Pat. No. 5,582,965;
Maskasky U.S. Pat. No. 5,604,085;
Eshelman et al U.S. Pat. No. 5,612,175;
Eshelman et al U.S. Pat. No. 5,612,176;
Levy et al U.S. Pat. No. 5,612,177;
Wilson et al U.S. Pat. No. 5,614,358;
Eshelman et al U.S. Pat. No. 5,614,359;
Maskasky U.S. Pat. No. 5,620,840;
Wen et al U.S. Pat. No. 5,641,618;
Irving et al U.S. Pat. No. 5,667,954;
Maskasky U.S. Pat. No. 5,667,955;
Maskasky U.S. Pat. No. 5,693,459;
Black et al U.S. Pat. No. 5,709,988;
Deaton et al U.S. Pat. No. 5,726,007;
Irving et al U.S. Pat. No. 5,728,515;
Bryant et al U.S. Pat. No. 5,728,517;

Once the cuprous ions have been adsorbed to the surfaces of the host grains, a silver salt in crystalline form is preferentially deposited adjacent at least one of the corners and edges of the host tabular grains. Generally imaging performance advantages attributable to the presence of the silver salt are increased as the percentage of the total host grains containing at least one deposition site is increased and the percentage of the total host grain surface area occupied by the silver salt is decreased. Thus, it is preferred to limit the silver salt to less than 25 percent of total surface area of the host grains. Most preferably the silver salt is limited to less than 10 (and optimally less than 5) percent of total surface area of the host grains. With monolayer coverage of adsorbed cuprous ion on the host grains, it is possible to achieve at least one identifiable silver salt deposition site on greater than 75 percent of the total host grains. It is generally preferred that greater than 50 percent of the host tabular grains exhibit at least one identifiable silver salt deposition site. In a well settled sensitized tabular grain emulsion, greater than 50 percent of the tabular grains having hexagonal major faces have three or more silver salt deposition sites adjacent grain corners.

Detectable improvements in imaging characteristics have been observed with silver salt concentrations as low as 0.05 mole percent, based on total silver forming the composite grains—i.e., total silver. On the other hand, no advantages have been observed by increasing silver salt concentrations to greater than 50 percent of total silver. Preferred silver salt concentrations are in the range of from 0.3 to 25 mole percent, based on total silver, and most preferably are in the range of from 0.5 to 10 mole percent, based on total silver.

The deposition of a variety of silver halides as well as non-halide silver salts, such as silver thiocyanate, silver phosphate, silver cyanide, and silver carbonate, are disclosed by the Maskasky deposition patents (U.S. Pat. Nos. 4,435,501, 4,463,087 and 4,471,050, cited above and here incorporated by reference). Any silver salt that has been demonstrated in the art to be capable of forming one or more deposits on a silver halide grain having predominantly {111} crystal faces can be employed in the practice of the invention.

Where the host grains are small (e.g., ECD less than 0.2 $\mu$m) or thin (e.g., tabular grains with thicknesses of less than 0.2 μm), it is preferred to deposit onto the host grains a silver salt having a solubility at least equal to that of the silver halide forming the host tabular grains. For example, when the host grain is a silver bromide or iodobromide grain, high stability of the host grains is observed when silver bromide, silver chloride, or a mixture of both are deposited. Similarly, high bromide grains exhibit high stability when silver thiocyanate, which has a higher solubility than silver bromide, is deposited. The Maskasky deposition patents also disclose the deposition of a lower solubility silver halide or non-halide silver salt onto a higher solubility host grain. For example, the deposition of silver iodobromide onto silver bromide host grains as well as the deposition of silver bromide or silver thiocyanate onto silver chloride host grains is specifically disclosed.

When the composition of the host grains and the silver salt deposition are the same, the silver salt deposition forms protrusions that are extensions of the crystal structure of the host grains. For example, the deposition of silver bromide onto a silver bromide host grain forms protrusions that are extensions of the crystal lattice structure of the host grains.

When, however, even a small amount of a silver salt not found in the host grains is incorporated in the protrusions or vice versa, the crystal lattice structure of the protrusions become measurably different from that of the host grains. In this instance the protrusions take the form of epitaxial crystalline deposits on the host grains. For example, silver chlorobromide deposited onto silver chlorobromide host grains that measurably differs in chloride content forms an epitaxial deposit (a.k.a., epitaxy), since silver chloride and silver bromide (both of which form a face centered cubic crystal lattice structure) form differing crystal lattice unit cell spacings.

It has been observed that epitaxial deposits on host grains are particularly useful in obtaining imaging advantages. While this observed effect does not depend upon any particular theory, it has been speculated that sites for trapping photo-electrons (electrons promoted to the conduction band by photon capture) are created by the epitaxial interfaces, resulting in higher observed levels of photosensitivity.

The specific selections of silver salt epitaxy disclosed by the Maskasky deposition patents are specifically contemplated. When the host grains are high bromide grains (e.g., silver bromide or silver iodobromide), optimum selections of silver salt epitaxy are disclosed by Daubendiek et al U.S. Pat. Nos. 5,494,789, 5,503,971, 5,576,168, and 5,573,902; Olm et al U.S. Pat. Nos. 5,503,970 and 5,576,171; Deaton et al U.S. Pat. Nos. 5,582,965 and 5,726,007; Maskasky U.S. Pat. Nos. 5,604,085 and 5,620,840; and Eshelman et al U.S. Pat. Nos. 5,612,175, 5,612,176 and 5,614,359, the disclosures of which are here incorporated by reference.

The inclusion of performance modifying dopants in the silver salt epitaxy is specifically contemplated. Conventional silver salt dopants and their function are disclosed by the Maskasky deposition patents. Specifically preferred silver salt protrusion dopants are disclosed by Daubendiek et al, Olm et al and Deaton et al, cited in the preceding paragraph. Conventional dopants can, of course, be present in host grains, and compatible combinations of dopants in the host grains and silver salt epitaxy are specifically contemplated.

In the simplest form of practicing the invention, as soon as the host grains have reached a desired size during precipitation, silver and halide salt additions or silver halide fine grain addition is discontinued, copper is introduced into the dispersing medium within the reaction vessel containing the silver halide host grains, cuprous ions are adsorbed to the host grains, the silver salt is precipitated onto the host grains by adding a soluble silver salt (e.g. silver nitrate) and a soluble salt capable of reacting with the soluble silver salt to form a relatively insoluble silver salt. For example, the soluble salt can take the form of ammonium or alkali halide, thiocyanate, or phosphate. Once the desired quantity of the silver salt has been precipitated onto the host grains, formation of the composite grains is complete, and subsequent stages of emulsion manufacture, such as, washing, sensitization, and addenda addition can take any convenient conventional form.

Where the silver salt itself acts to increase the imaging speed of the emulsion, no subsequent sensitization step is required. Spectral sensitization can be dispensed with, since the emulsions have native sensitivity to light and no spectral sensitizing dye is required to be employed as a site director. Similarly, no additional chemical sensitization beyond that achieved by silver salt deposition is required.

However, in most applications it is preferred to maximize the sensitivity of the emulsions by combining a conventional chemical sensitization procedure with the silver salt deposition described above. The silver salt deposition, as taught by the Maskasky deposition patents, can be undertaken either prior to or subsequent to chemical sensitization. Any of the conventional chemical sensitization techniques disclosed in *Research Disclosure,* Item 38957, cited above, IV. Chemical sensitization. The invention is particularly compatible with nobel metal (e.g., gold) and/or middle chalcogen (e.g., sulfur and/or selenium) chemical sensitizations.

It is specifically contemplated to incorporate one or a combination of spectral sensitizing dyes in the emulsions of the invention. Specific illustrations of spectral sensitizing dyes are provided by *Research Disclosure,* Item 38957, cited above, V. Spectral sensitization and desensitization, A. Sensitizing dyes. While spectral sensitizing dye addition is commonly undertaken following chemical sensitization, the inverse order of sensitization (commonly referred to as dye in the finish) is particularly advantageous in sensitizing tabular grain emulsions, as illustrated by Kofron et al U.S. Pat. No. 4,439,520. It is also known that photographic advantages can be realized by having one or more spectral sensitizing dyes present during host grain precipitation, as illustrated by *Research Disclosure,* Item 38957, I. Emulsion grains and their preparation, D. Grain modifying conditions and adjustments, paragraph (6). If desired, the spectral sensitizing dye can be chosen to act as a site director as taught by the Maskasky deposition patents to supplement the site direction provided by the cuprous ions.

The composite silver halide grains are suspended in an aqueous dispersing medium. The emulsions are formed in the presence of a hydrophilic colloid peptizer and a binder is subsequently added to facilitate coating. The emulsion vehicle, the peptizer and binder, is typically gelatin or a gelatin derivative; however, any conventional vehicle as well as conventional related addenda, such as hardener, vehicle extenders, and the like can be employed. Such conventional emulsion components are illustrated by *Research Disclosure,* Item 38957, II. Vehicles, vehicle extends, vehicle-like addenda and vehicle related addenda.

Aside from the features described above, the emulsions of this invention and their preparation can take any desired conventional form. For example, although not essential, after a novel emulsion satisfying the requirements of the invention has been prepared, it can be blended with one or more other novel emulsions according to this invention or with any other conventional emulsion. Conventional emulsion blending is illustrated in *Research Disclosure,* Item 38957, Section I. Emulsion grains and their preparation, E. Blends, layers and performance categories. Other common, but optional features are illustrated by *Research Disclosure,* Item 38957, Section VII, Antifoggants and stabilizers; Section VIII, Absorbing and scattering materials; Section IX, Coating physical property modifying agents; Section X, Dye image formers and modifiers. The features of Sections II and VII–X can alternatively be provided in other photographic element layers.

The photographic applications of the emulsions of the invention can encompass other conventional features, such as those illustrated by *Research Disclosure,* Item 38957, Sections:

XI. Layers and layer arrangements
XII. Features applicable only to color negative
XIII. Features applicable only to color positive
XIV. Scan facilitating features
XV. Supports
XVI. Exposure
XVII. Physical development systems
XVIII. Chemical development systems
XIX. Development
XX. Desilvering, washing, rinsing and stabilizing (post-development)

EXAMPLES

This invention can be further appreciated by reference to the following specific embodiments.

EMULSION I

To 297 g (0.500 mol) of a host silver bromide {111} tabular grain emulsion (mean ECD 4.2 μm, mean t 0.07 μm, tabular grain projected area >70%) were added 100 mL of distilled water. The temperature was then equilibrated to 40° C. The pAg and pH of the melt were 8.1 and 5.9, respectively. To the stirred emulsion was added 2.66 mL of a 3.764 M sodium chloride solution.

A 0.25 M cuprous ion solution was prepared by dissolving 0.582 g of $Cu(NO_3)_2 2.5H_2O$ (0.005 mol/Ag mol) in 10 mL of distilled water which had been purged of oxygen by slowly bubbling in pure nitrogen. Then 0.242 g of L-ascorbic acid was added to reduce the $Cu^{++}$ to $Cu^{+}$. This cuprous ion solution was then added to the emulsion melt at a rate of 4 mL/min. The amount of cuprous ion was calculated to be sufficient to provide 100% of monolayer coverage on the host grains.

To the melt was next added 19.03 mL of a solution 0.50 M in each of sodium bromide and sodium chloride at a rate of 10 mL/min. Then 3.5 mole % of additional silver halide was precipitated by addition of 35.3 mL of a 0.50 M silver nitrate solution at a rate of 23 mL/min.

Typical resulting composite grains are shown in FIG. 1. The epitaxial deposits are primarily confined to areas adjacent the corners of the host grains.

EMULSION 2

This emulsion was prepared similarly as Emulsion 1, except that the amounts of copper salt and L-ascorbic acid added were adjusted to 0.873 g and 0.363 g, respectively. This increased the cuprous ion concentration to 150% of monolayer coverage.

EMULSION 3

This emulsion was prepared similarly as Emulsion 1, except that the amounts of copper salt and L-ascorbic acid added were adjusted to 1.16 g and 0.484 g, respectively. This increased the cuprous ion concentration to 200% of monolayer coverage.

EMULSION 4

This emulsion was prepared similarly as Emulsion 1, except that no copper salt was added and 0.242 g of L-ascorbic acid was added in 10 mL of water. This emulsion was prepared to demonstrate performance in the absence of a cuprous ion adsorbed site director.

EMULSION 5

To 297 g (0.500 mol) of a host silver bromide {111} tabular grain emulsion (mean ECD 4.2 μm, mean t 0.07 μm, tabular grain projected area >70%) were added 100 mL of distilled water. The temperature was then equilibrated to 40° C. The pAg and pH of the melt were 8.14 and 5.9, respectively. To the stirred emulsion was added 2.66 mL of a 3.764 M sodium chloride solution.

A 0.25 M cuprous ion solution was prepared by dissolving 0.582 g of $Cu(NO_3)_2 2.5H_2O$ (0.005 mol/Ag mol) in 10 mL of distilled water which had been purged of oxygen by slowly bubbling in pure nitrogen. Then 0.242 g of L-ascorbic acid was added to reduce the $Cu^{++}$ to $Cu^{+}$. This cuprous ion solution was then added to the emulsion melt at a rate of 4 mL/min. The amount of cuprous ion was calculated to be sufficient to provide 100% of monolayer coverage on the host grains.

To the melt was next added 20.00 mL of a solution 0.84 M in sodium chloride at a rate of 10 mL/min. Then 3.5 mole % of additional silver halide was precipitated by addition of 35.3 mL of a 0.50 M silver nitrate solution at a rate of 23 mL/min.

Figure 2:
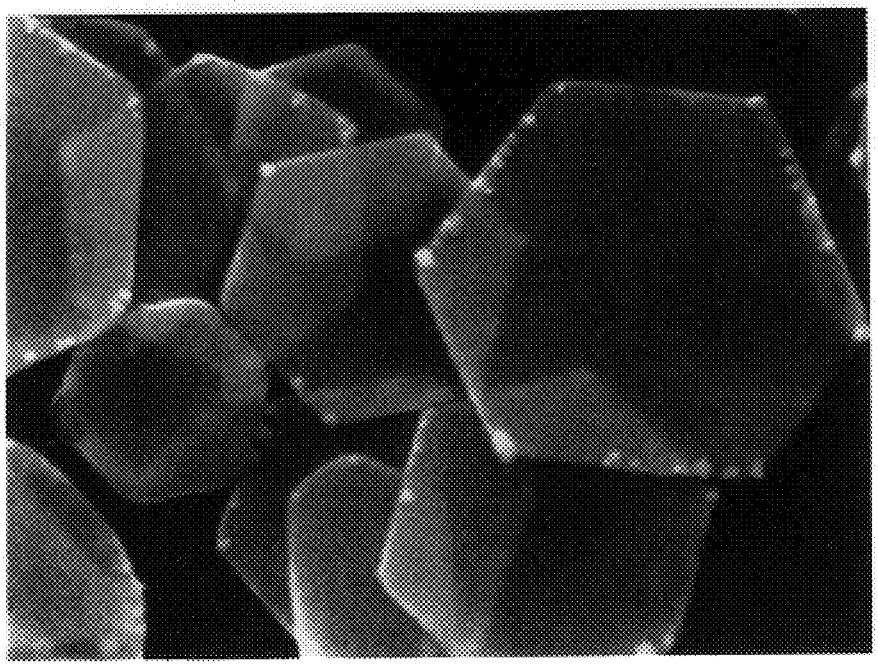

Typical resulting composite grains are shown in FIG. 2. The epitaxial deposits are primarily confined to areas adjacent the comers and edges of the host grains.

EMULSION 6

To 613.8 g (0.834 mol) of a host silver bromide {111} tabular grain emulsion (mean ECD 3.25 μm, mean t 0.08 μm, tabular grain projected area >70%) were added 922 mL of distilled water. The temperature was then equilibrated to 40° C. The pAg of the melt was adjusted to 9.5 by the dropwise addition of a 0.25 M potassium bromide solution, and the temperature was increased 55° C.

To the stirred emulsion was added a degassed solution of 16.75 g of $Cu(NO_3)_2 2.5H_2O$ and 7.00 g of L-ascorbic acid in 80 mL of distilled water at a rate of 8 mL/min over 10 minutes. Silver nitrate (3.00 M) was then pumped into the emulsion at a rate of 4.0 mL/min until a pAg of 7.9 was reached, at which point 3.00 M sodium bromide was introduced into the emulsion at a rate of 4.00 mL/min while maintaining the pAg at about 7.9 for 26.2 minutes.

The emulsion was then cooled to 40° C. and 22.9 g of gelatin in 60 mL of distilled water were added. The emulsion was chill set and stored at 10° C.

EMULSION SUMMARY

A summary of significant differences between the emulsions is contained in Table I.

TABLE I

| | % Monolayer | Epitaxy | |
|---|---|---|---|
| Emulsion | Coverage | Location | Composition |
| 1 | 100 | corners | $AgBr_{0.5}Cl_{0.5}$ |
| 2 | 150 | corners | $AgBr_{0.5}Cl_{0.5}$ |
| 3 | 200 | corners | $AgBr_{0.5}Cl_{0.5}$ |
| 4 | 0 | none | none |
| 5 | 100 | edges | AgCl |
| 6 | 1200 | corners | AgBr |

PERFORMANCE COMPARISON

To demonstrate the advantageous characteristics of emulsions satisfying the requirements of the invention, the performance of Emulsion 1 was compared to performance of Host 1, the host emulsion employed in the preparation of Emulsion 1.

The following spectral sensitizing dyes were employed:

Dye 1 Anhydro-5-chloro-9-ethyl-5'-phenyl-3'-(3-sulfopropyl)oxacarbocyanine hydroxide, sodium salt Dye 2 Anhydro-3,9-diethyl-3'-[N-(methylsulfonyl) carbamoylmethyl]-5-phenylbenzothiazolo oxacarbocyanine hydroxide The following cyan dye-forming coupler, C-1, was employed:

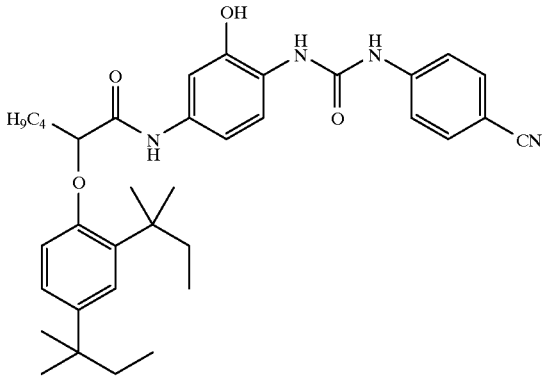

Each of Emulsion 1 and Host 1 received the following sensitization:

A 0.05 mole sample of emulsion was melted at 40° C. Bone gelatin and water were added to bring the total gelatin level of the emulsion to 65 g/Ag mole. Next, an aqueous solution containing 9 mg of sodium thiocyanate was added to the emulsion. To the emulsion were added Dye 1 and Dye 2 in a molar ratio of 4.5:1 at a level of 1.294 millimoles of total dye per Ag mole. The emulsion was then stirred at 40° C. for 30 minutes. Gold and sulfur sensitization to substantially optimum levels was undertaken, and the temperature of the emulsion was then raised to 50° C. and held for 15 minutes. The emulsion was then cooled to 40° C. and additional gelatin and water were added along with an aqueous solution containing 50 mg of 4-hydroxy-6-methyl-1,3,3a,7-tetraazaindene, sodium salt.

The sensitized emulsions Emulsion 1 and Host 1 were each coated on a cellulose acetate photographic film support that had an antihalation backing and a gelatin subbing layer to receive the emulsion. Emulsion laydown was 0.81 g Ag/$m^2$. This layer also contained 1.29 g/$m^2$ of the cyan dye-forming coupler C-1 and surfactant. The total gelatin content of the emulsion layer was 3.23 g/$m^2$. The emulsion layer was overcoated with a 2.69 g/$m^2$ gelatin layer which also contained surfactant and 1.75% by weight of bis (vinylsulfonyl)methane hardener, based on total gelatin on the emulsion side of the support.

Each coating was given a 5500° K. daylight balanced exposure through a calibrated neutral step tablet and through a Wratten™ 9 filter, which permitted transmission at wavelengths longer than 480 nm.

The exposed coatings were then developed for 3 minutes and 15 seconds using the Kodak Flexicolor™ C41 color negative process.

The performance of the Emulsion 1 and Host 1 coatings are compared in Table II.

TABLE II

| Emulsion | Dmin | Dmax | Relative Inertial Speed | Maximum Contrast |
|---|---|---|---|---|
| Host 1 | 0.047 | 1.80 | 100 | 1.56 |
| Emul. 1 | 0.043 | 1.90 | 106 | 1.71 |

From Table II it is apparent that maximum density, speed and maximum contrast were all improved by the addition of the silver salt epitaxy to the host grains.

The invention has been described in detail with particular reference to preferred embodiments thereof, but it will be understood that variations and modifications can be effected within the spirit and scope of the invention.

What is claimed is:

1. A radiation-sensitive silver halide emulsion comprised of a dispersing medium and composite grains each including a silver halide host grain having predominantly {111} crystal faces, a site director for silver salt deposition adsorbed to the {111} crystal faces of the host grain, and silver salt protrusions having their highest incidence adjacent at least one of the corners and edges of the host grain,

WHEREIN the site director is comprised of cuprous ions.

2. A radiation-sensitive silver halide emulsion according to claim 1 wherein the host grains contain greater than 50 mole percent bromide, based on silver.

3. A radiation-sensitive silver halide emulsion according to claim 1 wherein the silver salt consists essentially of silver halide.

4. A radiation-sensitive silver halide emulsion according to claim 3 wherein the silver halide forming the protrusions exhibits a solubility at least equal to that of the silver halide forming the host grains.

5. A radiation-sensitive silver halide emulsion according to claim 1 wherein greater than 50 percent of total grain projected area is accounted for by tabular host grains.

6. A radiation-sensitive silver halide emulsion according to claim 5 wherein the tabular host grains exhibit an average aspect ratio of greater than 5.

7. A radiation-sensitive silver halide emulsion according to claim 1 wherein the cuprous ions are adsorbed to the host grains in a concentration ranging from at least 25 percent to 10 times monolayer coverage.

8. A radiation-sensitive silver halide emulsion according to claim 7 wherein the cuprous ions are adsorbed to the host grains in a concentration of at least 60 percent of monolayer coverage.

9. A radiation-sensitive silver halide emulsion according 7 wherein the cuprous ions are adsorbed to the host grains in a concentration of up to 3 times monolayer coverage.

10. A radiation-sensitive silver halide emulsion according to claim 1 wherein the composite grains account for greater than 50 percent of the total grains present in the emulsion.

* * * * *